US005200155A

United States Patent [19]

Obermueller

[11] Patent Number: 5,200,155

[45] Date of Patent: Apr. 6, 1993

[54] APPARATUS FOR BURNING OXIDIZABLE COMPONENTS IN AN EXHAUST FLOW

[75] Inventor: Herbert Obermueller, Linsengericht, Fed. Rep. of Germany

[73] Assignee: H. Krantz GmbH & Co., Aachen, Fed. Rep. of Germany

[21] Appl. No.: 667,514

[22] Filed: Mar. 11, 1991

[30] Foreign Application Priority Data

Mar. 10, 1990 [DE] Fed. Rep. of Germany ..... 4007625

[51] Int. Cl.[5] ..... B01D 53/00

[52] U.S. Cl. ..... 422/182; 422/173; 422/176; 422/183; 422/201; 110/203; 110/204; 110/211; 432/72

[58] Field of Search ..... 422/173, 176, 182, 183, 422/201; 110/203, 204, 211; 432/72, 222

[56] References Cited

U.S. PATENT DOCUMENTS 3,549,333 12/1970 Tabak ..... 422/173

FOREIGN PATENT DOCUMENTS 0040690 12/1981 European Pat. Off. .

3532232 3/1987 Fed. Rep. of Germany .

*Primary Examiner*—Robert J. Warden
*Assistant Examiner*—Laura E. Collins
*Attorney, Agent, or Firm*—W. G. Fasse

[57] ABSTRACT

Oxidizable components in an exhaust air or gas flow are burnt by a burner in a combustion chamber enclosed in a housing. For this purpose the exhaust air is distributed into inlet ends of heat exchanger pipes which have outlet ends near the burner. The arrangement is such that the exhaust air carrying oxidizable components flows through the heat exchanger pipes while the exhaust air freed of oxidizable components flows around the heat exchanger pipes. In order to permit effective heat expansions and contractions of the heat exchanger pipes, these pipes have an L-configuration with radially inwardly extending legs having inlet ends connected into perforations in a jacket forming an exhaust air distribution chamber, and with substantially axially extending legs having outlet ends leading close to the burner. An air inlet leads centrally into the distribution chamber and a cleaned air outlet leads out of the housing.

17 Claims, 1 Drawing Sheet

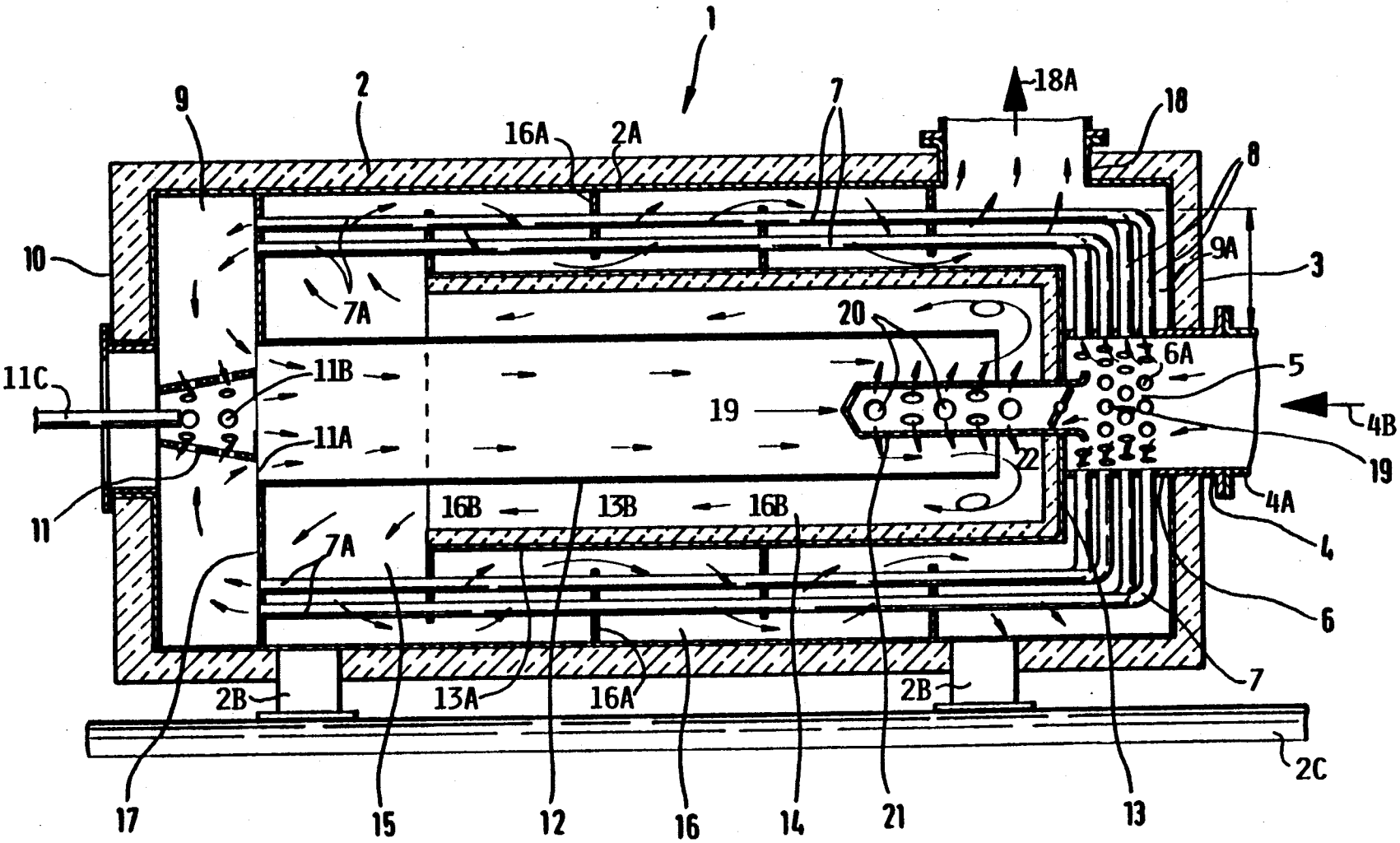
1
2
2A
2B
2C
3
4
4A
4B
5
6
6A
7
7A
8
9
9A
10
11
11A
11B
11C
12
13
13A
13B
14
15
16
16A
16B
17
18
18A
19
20
21

APPARATUS FOR BURNING OXIDIZABLE COMPONENTS IN AN EXHAUST FLOW

CROSS-REFERENCE TO RELATED APPLICATIONS

The present invention relates to the following U.S. patent applications:

1) U.S. Ser. No. 07/823,048, filed: Jan. 16, 1992,now U.S. Pat. No. 5,161,966;
2) U.S. Ser. No. 07/677,516, filed: Mar. 11, 1991, now abandoned;
3) U.S. Ser. No. 07/667,513, filed: Mar. 11, 1991, now allowed.

FIELD OF THE INVENTION

The invention relates to an apparatus for burning oxidizable components in an exhaust air flow or exhaust gas flow.

BACKGROUND INFORMATION

It is known to burn oxidizable components of an exhaust gas or air flow in a cylindrical housing having an inlet port and an outlet port. The inlet port in such devices leads into a distribution chamber which is connected through heat exchanger tubes to a ring chamber neighboring an end of the housing, whereby these heat exchanger pipes are angled radially outwardly at the inlet ends and extend over a substantial portion of the length of the housing. A burner is arranged concentrically in the ring chamber and a flue gas mixing pipe formed as a cylindrical chamber section is arranged coaxially to the burner and facing the burner. The flue gas mixing pipe is surrounded by a main combustion chamber which in turn is surrounded by a ring space in which the heat exchanger pipes are located. The ring space in turn is connected to the outlet port.

German Patent Publication (DE) 3,532,232 C2 discloses further details of the just described combustion device. It is desirable to heat the exhaust air or gas carrying the oxidizable components to a preheating temperature as close as possible to the combustion chamber temperature. Such preheating of the exhaust gas or air imposes substantial problem with the mounting of the heat exchanger pipes in the housing, especially under dynamic operating conditions that is when the exhaust gas is subject to temperature changes, to volume flow variations, and to variations in the quantity of noxious components in the exhaust gas or air. These problems are due to the fact that the mounting of the heat exchanger pipes must compensate for or permit the thermal expansions and contractions of the heat exchanger pipes. If it is necessary to operate the apparatus with a very small exhaust gas volume it happens that heat exchanger pipes carrying a laminar flow are located directly next to heat exchanger pipes carrying a turbulent flow. As a result, different heat transfers take place at the pipe walls leading necessarily to different pipe wall temperatures with the result that even heat exchanger pipes located directly next to each other or neighboring each other are exposed to different thermal expansions, especially longitudinal expansions or contractions.

In order to permit an expansion of the heat exchanger pipes, especially a temperature responsive expansion, by structurally simple means, to thus protect the heat exchanger pipes against damage, the colder ends that is the inlet ends of the heat exchanger pipes are bent radially outwardly in the above mentioned known apparatus. Additionally, the exhaust air which has been cleaned of its oxidizable components and which flows around the outside of the heat exchanger pipes is lead over the pipe bends and over the bent away pipe sections.

The arrangement of the heat exchanger pipes in the known apparatus mentioned above, so that these pipes extend with their bent ends radially outwardly, has yet another disadvantage when it is necessary to avoid relatively large housing diameters. Space conditions requiring small diameter housings for the known device result in a very crowded arrangement of the heat exchanger pipes within the available small diameter. As a result, the combustion chamber as far as it is located inside the heat exchanger, has a very small volume. In other words, the main portion of the combustion chamber that is a large proportion of the total combustion chamber volume is located outside of the section which surrounds the heat exchanger pipe. As a result, housing diameters that must be kept as small as possible, conventionally result in housings that necessarily have a substantially increased length. Still another disadvantage is seen in that the radially outwardly bent legs of the heat exchanger pipes must be relatively short to accommodate the permissible housing diameter limits. As a result, when these short bent legs of the heat exchanger pipes are welded into an outer wall of the housing, their mounting becomes too rigid and they cannot compensate any heat expansions worth mentioning. At best, the conventional mounting is capable of compensating heat expansion differences among the heat exchanger pipes themselves. However, compensations that are required for accommodating expansion differences between the complete heat exchanger pipe bundle on the one hand and the jacket that surrounds the pipe bundle are not possible in the conventional device. As a result, it is necessary to equip the conventional device with a main expansion compensator which adds substantially to the costs of the conventional device.

OBJECTS OF THE INVENTION

In view of the foregoing it is the aim of the invention to achieve the following objects singly or in combination:

to construct an apparatus for the burning of oxidizable components in an exhaust gas or air flow in such a way that a compact construction is combined with an efficient ability of the device to permit thermal expansions and contractions of the heat exchanger pipes;

to permit each individual heat exchanger pipe to undergo substantial length changes as a result of heat expansions and contractions without the need for overcoming substantial adjustment forces for this purpose;

to permit the entire bundle of heat exchanger pipes to compensate for thermal expansions and contractions relative to a jacket of the device;

to avoid damage to the structure as a result of thermal expansions and contractions in spite of a compact construction and arrangement of the heat exchanger pipes; and to efficiently guide the hot flue gases around the heat exchanger pipes over a substantial length thereof to efficiently preheat the air or gas to be cleaned.

SUMMARY OF THE INVENTION

The above objects have been achieved according to the invention by bending the inlet ends or legs of the heat exchanger tubes radially inwardly and locating these radially inwardly bent ends near the housing end that is located opposite the burner, and by leading the open ends of the radially inwardly bent legs of the heat exchanger pipes into a cylindrical jacket that forms or surrounds a gas or air distribution chamber next to the et port of the apparatus.

By bending the inlet ends of the heat exchanger pipes radially inwardly, it is possible to increase the length of these inlet ends even if the housing diameter is relatively small. The length of the radially inwardly bent inlet ends of the heat exchanger pipes will depend on the diameter of the cylindrical jacket which surrounds the inlet distribution chamber. However, this diameter still permits selecting the length of the radially inwardly extending pipe legs so that each pipe still has a substantial ability to compensate for its heat expansion and contraction by elastic bending of the pipe legs relative to each other.

It is possible to select the diameter of the jacket that surrounds the distribution chamber just large enough so that it provides the necessary surface area for the number of apertures required to lead the inlet ends of the heat exchanger pipes the distribution chamber. The best arrangement of the jacket and thus of the distribution chamber is concentric to the longitudinal axis of the housing, whereby the inlet port is arranged coaxially to the longitudinal housing axis. This arrangement of the components relative to each other provides a flow efficient construction so that the inlet port can merge into the cylindrical jacket of the distribution chamber wit any steps. Preferably, the inlet ends of the radially inwardly bent heat exchanger pipes are welded or brazed into the apertures of the distribution chamber jacket.

In order to control the quantity of air that flows into the inlet ends of the heat exchanger pipes, it is advantageous to provide a by-pass that leads from the distribution chamber into the flue gas mixing pipe. The by-pass may be a pipe section with radial holes leading into the flue gas mixing pipe and an open end in the distribution chamber. A valve, such as a flap valve, may be provided in the by-pass to control the quantity of gas that flows directly into the flue gas mixing pipe rather than into the heat exchanger pipes. The apparatus according to the invention permits the installation of such a by-pass even in those instances where the apparatus initially was not equipped with such a by-pass. The by-pass is preferably used only for certain operational modes, for example, when the proportion of combustible components in the air or gas flow to be cleaned is relatively low.

BRIEF DESCRIPTION OF THE DRAWING

In order that the invention may be clearly understood, it will now be described, by way of example, with reference to the single Figure of the accompanying drawing which shows an axial longitudinal sectional view through an air cleaning apparatus according to the invention.

DETAILED DESCRIPTION OF PREFERRED EXAMPLE EMBODIMENTS AND OF THE BEST MODE OF THE INVENTION

The air cleaning apparatus according to the invention comprises a longitudinal cylindrical housing 1 formed of an inner casing 2A or liner surrounded by heat insulation 2. The housing 1 is supported by mounting brackets or legs 2B secured to a support 2C.

The right-hand end of the housing 1 is closed by an axially facing end wall 3 provided with a coaxially arranged inlet port 4 connected to a supply pipe 4A through which the air or gas 4B to be cleaned is introduced into the apparatus. The inlet port 4 leads into a distribution chamber 5 formed by an inlet cylinder 6, preferably having the same inner diameter as the inlet port 4 so that there is a smooth stepless transition between the inlet port 4 and the inlet cylinder 6.

The inlet cylinder 6 forming the distribution chamber 5 has radially extending perforations 6A therein so that incoming air or gas is distributed into heat exchanger pipes 7 which, according to the invention, have radially inwardly bent inlet ends or legs 8 connected to the apertures 6A to communicate with the distribution chamber 5, and longitudinal, substantially axially extending legs with outlet ends 7A to be described below. The inlet ends of the radially inwardly bent pipe legs 8 are welded or brazed into the perforations 6A. The long legs of the heat exchanger pipes 7 are arranged in a cylindrical configuration and extend axially or substantially axially over a substantial proportion of the length of the housing 1.

The outlet ends 7A of the heat exchanger pipes 7 leads into a first ring chamber 9 that is located next to the left-hand axially facing end wall 10 of the housing 1. The end wall 10 has a central hole therein in which a burner 11 is concentrically mounted relative to the first ring chamber 9. The axially inner end the burner 11 faces into a first pipe section forming a flue gas mixing pipe or space 12 formed as a first cylindrical chamber section having at its burner facing end a flange end wall 17 serving to mount the pipe section 12 in the housing 1 and for separating the ring chamber 9 from a flow deflecting ring space 15 to be described below. The inner diameter of the pipe section 12 is larger than the outer diameter of the inwardly facing end of the burner 11 to form a ring gap 11A through which gases flow as indicated by the arrows. The burner 11 has apertures 11B in its side wall so that gases also flow into the burner. The right open end of the pipe section 12 ends with a spacing from a separator wall 13 which closes the axially inner end of the distribution chamber 5 on the one hand, and which forms an axial end wall of the main combustion chamber 14. The just mentioned spacing permits the gases in the pipe flue gas mixing 12 to flow into the main combustion chamber 14. A fuel pipe 11C leads into the burner 11.

The main combustion chamber 14 is formed by a second chamber or pipe section 13A, the right-hand end of which is closed by the separator wall 13. The surface of the second chamber or pipe 13A facing into the combustion chamber and the surface of the separator wall 13 facing the flue gas mixing pipe 12 are covered with a heat insulating layer 13B. The second chamber section 13A is axially shorter than the first chamber section formed by the flue gas mixing pipe 12 to form a flow deflection ring space 15 which leads into a flow ring chamber or space 16 surrounding the second chamber section 13A. The ring flow space 16 in turn is surrounded by the housing 1, or rather by the housing liner or casing 2A.

The inwardly facing surface of the end wall 3 and the separation wall 13 form a second ring chamber 9A in which the inlet cylinder 6 of the distribution chamber 5 is located and into which the relatively short radially inwardly bent inlet end legs 8 of the heat exchange pipes are connected as shown. The axially extending long legs of the heat exchange pipes pass longitudinally through the flow ring chamber 16. The outlet ends 7A of the pipes 7 pass through the flow deflection ring space 15 and through openings in the end wall 17 so that the preheated gas or air coming out of the ends 7A of the pipes 7 enter into the first ring chamber 9 as shown by the arrows. The ends 7A of the pipe 7 are secured in respective through-holes of the end wall 17, for example, by brazing or welding. The flow ring chamber or space is connected to an exhaust port 18 so that cleaned gases leave the housing 1 as indicated by the arrow 18A.

The just described arrangement of the components permits the heat exchanger pipes 7 to individually respond to different length changes due to heat expansion and contractions. The compensation is possible because the angle enclosed between the relatively short radially extending legs 8 and the axially extending long legs of the pipes 7 can change as temperature dependent length changes occur. Such change of the normally right angle between the just mentioned pipe legs requires very small forces or rather expansion forces so that any stress caused by compression, tensile or bending loads is minimized or altogether prevented in the heat exchanger pipes 7. Similarly, stress on the welding or brazing seams between the pipe ends and the inlet cylinder 6 on the one hand and the pipe ends 7A and the end wall 17 on the other hand, is also minimized.

According to the invention, a by-pass 19 and a controllable valve 22 are provided for selectively controlling the proportion of air or gas to be cleaned that may pass directly into the flue gas mixing pipe 120 and into the spacing between the right-hand free end of the flue gas mixing pipe 12 and the inwardly facing surface of the separation wall 13, or directly into the heat exchanger pipes 7. For this purpose the by-pass 19 comprises a pipe section 21 that is preferably closed at its left-hand end and open at its right-hand end which reaches into the chamber 5. The pipe section 21 has radial holes 20 through which the air to be cleaned can pass into the flue gas flow. The controllable valve 22 is, for example, a flap valve 22 which is inserted in the open end portion of the pipe section 21, whereby it is possible to adjust any position between a completely closed pipe section 21 at its inlet and a completely open pipe section 21.

The Figure further shows first baffle plates 16A that reach radially inwardly from the inner housing wall into the flow ring space 16 and second baffle plates 16B that reach radially outwardly into the space 16 from the second chamber section 13A. The first baffle rings alternate with the second baffle rings so that the flow of the combustion gases must meander around these baffle plates for increasing the contact between the combustion gases and the surfaces of the heat exchange pipes 7. Preferably, the baffle plates 16A and 16B are provided with holes through which the heat exchange pipes 7 extend.

Incidentally, the burner 11 has an axial length corresponding substantially to an axial length of the first ring chamber 9 so that the mentioned ring gap 11A is formed, whereby combustion gases flow through the ring gap and through the burner due to the apertures 11B in the burner jacket.

Although the invention has been described with reference to specific example embodiments it will be appreciated that it is intended to cover all modifications and equivalents within the scope of the appended claims.

What I claim is:

1. An apparatus for burning oxidizable components in an exhaust gas flow, comprising an axially extending cylindrical housing means for enclosing a combustion chamber, a first end wall for closing one end of said housing means, an exhaust gas inlet pipe section passing through said first end wall for leading exhaust gas flow into said housing means, a second end wall for closing an opposite end of said housing means, a cylindrical first pipe section extending axially in said housing means and forming a flue gas mixing space inside said first pipe section, burner means mounted in a first ring chamber which is defined inside said housing means between a radially outwardly extending flange and said second end wall for at least partly burning components in exhaust gas, said first pipe section having a first open end facing said burner means and a second open end, said radially outwardly extending flange surrounding said first open end for mounting said first pipe section in said housing means, said burner means facing said first open end of said first pipe section, a second pipe section in said housing means surrounding said first pipe section to define a combustion chamber between said first and second pipe sections and to enclose a flow ring space between said second pipe section and said housing means, a separation wall closing one end of said second pie section, said separation wall being spaced from said second open end of said first pipe section to form a flow path between said separation wall and said first pipe section, said separation wall being axially spaced from said first end wall to form a second ring chamber between said separation wall and said first end wall, an inlet cylinder with perforations, said inlet cylinder being connected to said exhaust gas inlet pipe section and extending through said second ring chamber for forming an exhaust gas distribution chamber between said separation wall and said exhaust gas inlet pipe section, a plurality of heat exchange pipes each having an L-configuration with an axial leg extending substantially axially of said housing means in said flow ring space and a radial leg extending substantially radially inwardly of said housing means in said second ring chamber, each of said radially inwardly extending legs of said heat exchange pipes ending in connection with a respective one of said perforations of said inlet cylinder so that incoming exhaust gas is distributed into said radially inwardly extending legs of said heat exchange pipes, and a flow outlet means leading through said housing means from said flow ring space for discharging cleaned exhaust gases.

2. The apparatus of claim 1, wherein said exhaust gas distribution chamber formed by said inlet cylinder is arranged concentrically around a longitudinal central axis of said housing means, and wherein said exhaust gas inlet pipe section is arranged coaxially with said central axis.

3. The apparatus of claim 1, wherein said inlet cylinder forming said exhaust gas distribution chamber and said exhaust gas inlet pipe section have the same inner diameter, so that said exhaust gas inlet pipe section merges into said exhaust gas distribution chamber without any discontinuity.

4. The apparatus of claim 1, further comprising by-pass means for by-passing said heat exchange pipes so that exhaust gas from said exhaust gas distribution chamber can flow directly into said combustion chamber or into said flue gas mixing space inside said first pipe section.

5. The apparatus of claim 4, wherein said by-pass means comprise a by-pass pipe member extending coaxially within said housing means with an open end extending from said inlet cylinder forming said exhaust gas distribution chamber and passing through said space between said second end of said first pipe section and said separation wall into said first pipe section, said by-pass pipe member having radial holes for by-passing exhaust gas into said space and into said first pipe section forming said flue gas mixing space.

6. The apparatus of claim 5, wherein said by-pass pipe member has a closed end facing axially toward said burner means.

7. The apparatus of claim 4, further comprising flow control means arranged in said by-pass means for controlling a cross-section flow area through said by-pass means.

8. The apparatus of claim 7, wherein said by-pass means comprise a pipe member, and wherein said flow control means comprise a flap valve in said pipe member.

9. The apparatus of claim 1, wherein said flange of said first pipe section has through-holes therein, each of said axially extending legs of said heat exchange pipes ending in a respective one of said through-holes, so that exhaust gas flowing through said heat exchange pipes passes through said first ring chamber into said cylindrical first pipe section forming said flue gas mixing space in which flue gases flow at high speeds.

10. The apparatus of claim 1, wherein said housing means comprise a metal liner and a heat insulating outer jacket surrounding said metal liner.

11. The apparatus of claim 1, wherein said second pipe section and said separator wall comprise a cylindrical metal container and a heat insulating inner liner facing said first pipe section.

12. The apparatus of claim 1, further comprising radially extending baffle plates in said flow ring space for causing a hot gas flow to meander repeatedly around said heat exchange pipes.

13. The apparatus of claim 12, wherein said baffle plates extend alternately radially inwardly and radially outwardly.

14. The apparatus of claim 12, wherein said heat exchange pipes pass through said baffle plates.

15. The apparatus of claim 1, wherein said burner means has an axial length corresponding substantially to an axial length of said first ring chamber and a diameter smaller than an inner diameter of said first pipe section for forming a flow ring gap from said first ring chamber into said flue gas mixing space.

16. The apparatus of claim 1, wherein said burner means comprise a burner jacket with apertures therein for said exhaust gas to pass at least partly into said burner means through said apertures.

17. An apparatus for burning oxidizable components in an exhaust gas flow, comprising cylindrical housing means enclosing a combustion chamber, said housing means having a central longitudinal axis, a coaxial gas inlet cylinder having radial perforations therein, said inlet cylinder being positioned for a coaxial entry of exhaust gas at one end of said cylindrical housing means, burner means located coaxially at the other end of said housing means for burning polluted gas, gas exit means passing through a side wall of said housing means for discharging cleaned gas, gas flow means for leading an exhaust gas flow from said coaxial gas inlet cylinder through said combustion chamber to said gas exit means, said gas flow means comprising heat exchanger pipes for leading exhaust gas from said coaxial gas inlet cylinder to said burner means, said gas flow means comprising a further cylinder forming a flow chamber coaxially inside said housing means around said combustion chamber, means for mounting said heat exchanger pipes in said coaxial flow chamber for preheating exhaust gas before it reaches said burner means, each of said heat exchanger pipes having an L-configuration with a first leg extending axially toward said burner means and a second leg of lesser length that in said first leg leading radially inwardly in said housing means into a respective radial perforation of said coaxial gas inlet cylinder for feeding exhaust gas into each second leg of said heat exchanger pipes, whereby a right angle normally enclosed between said first leg and said second leg of said heat exchanger pipes can change into another angle in response to temperature changes for accommodating temperature dependent dimensional changes in said heat exchanger pipes.

* * * * *